US011569029B2

(12) United States Patent
Geissler et al.

(10) Patent No.: US 11,569,029 B2
(45) Date of Patent: Jan. 31, 2023

(54) FIELD DEVICE AND REMOTE STATION

(71) Applicant: Endress+Hauser Conducta GmbH+Co. KG, Gerlingen (DE)

(72) Inventors: Sebastian Geissler, Geithain (DE); Ronny Michael, Erlau (DE); Torsten Pechstein, Radebeul (DE); Stefan Robl, Hünxe (DE); Michael Dieterich, Waiblingen (DE)

(73) Assignee: Endress+Hauser Conducta GmbH+Co. KG, Gerlingen (DE)

( * ) Notice: Subject to any disclaimer, the term of this patent is extended or adjusted under 35 U.S.C. 154(b) by 0 days.

(21) Appl. No.: 16/926,012

(22) Filed: Jul. 10, 2020

(65) Prior Publication Data

US 2021/0012957 A1 Jan. 14, 2021

(30) Foreign Application Priority Data

Jul. 10, 2019 (DE) ..... 10 2019 118 712.5

(51) Int. Cl.
*H01F 38/14* (2006.01)
*G08C 17/04* (2006.01)

(52) U.S. Cl.
CPC ..... *H01F 38/14* (2013.01); *G08C 17/04* (2013.01); *H01F 2038/143* (2013.01)

(58) Field of Classification Search
CPC ... H01F 38/14; H01F 2038/143; G08C 17/04; G05B 19/042; G05B 2219/25257
See application file for complete search history.

(56) References Cited

U.S. PATENT DOCUMENTS

| | | | | |
|---|---|---|---|---|
| 3,387,606 | A | 6/1968 | Crafts et al. | |
| 2002/0075145 | A1* | 6/2002 | Hardman | B60C 23/0479 340/448 |
| 2010/0172090 | A1* | 7/2010 | Chatterjee | G06F 1/1656 361/679.58 |
| 2012/0091818 | A1* | 4/2012 | Wesemann | H02J 5/005 307/104 |
| 2012/0309397 | A1* | 12/2012 | Rao | H04W 36/30 455/437 |
| 2013/0005251 | A1* | 1/2013 | Soar | H02J 50/80 307/9.1 |
| 2013/0162268 | A1* | 6/2013 | Pechstein | H04Q 9/00 324/654 |

(Continued)

FOREIGN PATENT DOCUMENTS

| | | |
|---|---|---|
| CN | 103185601 A | 7/2013 |
| CN | 103840318 A | 6/2014 |

(Continued)

OTHER PUBLICATIONS

Merriam-Webster, "Definition of Longitudinal," pp. 1 (Year: NA).*

*Primary Examiner* — Pinping Sun
(74) *Attorney, Agent, or Firm* — Mark A. Logan; Endress+Hauser (USA) Holding Inc.

(57) ABSTRACT

The present disclosure relates to a field device, comprising: a first inductive interface, at least for transmitting and receiving data, especially for transmitting a value dependent on the measured condition; at least one second interface at least for receiving energy; and a first coupling body comprising the first, inductive interface and the second interface.

23 Claims, 10 Drawing Sheets

(56) References Cited

U.S. PATENT DOCUMENTS

2013/0285604 A1* 10/2013 Partovi ..... H04B 5/0037 320/108
2014/0042969 A1* 2/2014 Miller ..... H02J 7/0048 320/111
2014/0070620 A1* 3/2014 Yeh ..... H02J 1/10 307/104
2014/0152118 A1* 6/2014 Kim ..... H04B 5/0037 307/104
2014/0302782 A1* 10/2014 Raab ..... H01F 38/14 455/41.1
2015/0034807 A1* 2/2015 Lobbert ..... G01J 1/44 250/214.1
2015/0084431 A1* 3/2015 Yeh ..... H02J 7/0044 307/104
2015/0138031 A1* 5/2015 Van Gils ..... H02J 7/025 343/788
2015/0155892 A1* 6/2015 Haase ..... H01Q 1/2291 455/129
2015/0364943 A1* 12/2015 Vick ..... H02J 50/10 320/108
2015/0371771 A1* 12/2015 Abu Qahouq ..... H01F 38/14 307/104
2016/0147228 A1* 5/2016 Riski ..... B63H 21/213 701/21
2016/0175590 A1* 6/2016 Kulkarni ..... H04B 5/0075 607/57
2016/0301259 A1* 10/2016 Zeine ..... H02J 50/80
2017/0127982 A1* 5/2017 Larson ..... A61B 5/1495
2017/0141616 A1* 5/2017 Habraken ..... H02J 50/80
2018/0017416 A1* 1/2018 Haldorsen ..... G01D 11/245
2018/0172729 A1* 6/2018 Kirst ..... G01R 1/0416
2018/0191404 A1* 7/2018 Berger ..... H04B 10/116
2018/0351414 A1* 12/2018 Park ..... H02J 50/40
2018/0366983 A1* 12/2018 Geissler ..... H04B 5/0075
2019/0217737 A1* 7/2019 Lotfy ..... G05D 1/0231
2020/0284569 A1* 9/2020 Feda ..... F42C 11/04
2021/0175747 A1* 6/2021 Grunberg ..... H02J 50/12

FOREIGN PATENT DOCUMENTS

CN 104677410 A 6/2015
CN 105579092 A 5/2016
CN 105588595 A 5/2016
CN 206225649 U 6/2017
CN 107958581 A 4/2018
CN 207743766 U * 8/2018
CN 207743766 U 8/2018
CN 207884364 U 9/2018
CN 109142944 A 1/2019
DE 10218606 A1 11/2003
DE 202019101955 U1 5/2019
JP H0738349 B2 4/1995

* cited by examiner

| | 1H (Fig.2a) | 1L (Fig.2b) |
|---|---|---|
| 10H (Fig.2c) | Full Functionality | Full Functionality Mechanical adapter may be required |
| 10L (Fig.2d) | Basic Communication | Full Functionality |

Fig. 2e

FIELD DEVICE AND REMOTE STATION

CROSS-REFERENCE TO RELATED APPLICATION

The present application is related to and claims the priority benefit of German Patent Application No. 10 2019 118 712.5, filed on Jul. 10, 2019, the entire contents of which are incorporated herein by reference.

TECHNICAL FIELD

The present disclosure relates to a field device, a remote station and a measuring system comprising said two. The present disclosure further relates to a method for starting up such a field device.

BACKGROUND

In the field of process instrumentation in process analysis, interfaces between a field device and a remote station are known which are based on non-galvanic coupling. Such a field device is configured, for example, as a sensor, to which reference will be made first.

For example, the applicant's "Memosens" sensor type is to be mentioned here, such as a pH sensor "Orbisint CPS11D". This sensor uses an inductive energy and signal transmission between sensor and a remote station, i.e., for example, a cable that can be connected to the sensor.

By using an inductive interface, there are limitations with regard to, for example, the maximum power to be transmitted.

SUMMARY

The present disclosure is based on the object of proposing a more universal possibility of transmitting energy and/or data between a field device and a remote station, especially with a higher power.

The object is achieved by a field device comprising: a first inductive interface, at least for transmitting and receiving data, especially for transmitting a value dependent on the measurement variable; at least one second interface at least for receiving energy; and a first coupling body comprising the first, inductive interface and the second interface.

In one embodiment, the field device is configured as a sensor and comprises at least one sensor element for detecting a measurement variable of the process automation.

In one embodiment, the field device is configured as an actuator or as actuators.

In one embodiment, the field device is configured as a pump.

In one embodiment, the field device is configured as a fitting, especially as a quick-change fitting. The fitting comprises a sensor and can be moved by means of an electric or pneumatic drive.

In one embodiment, the field device is configured as a splitter. The data and energy are distributed or split by means of the splitter.

The embodiments mentioned below apply to all embodiments of the field device.

In one embodiment, the first inductive interface is configured to receive energy.

In one embodiment, the second interface is configured to transmit and receive data.

In one embodiment, the field device comprises a data memory, wherein the data memory comprises persistent data, especially calibration data, serial number, tag, calibration values and/or logbook, of the field device. The logbook is, for example, a memory for various field device internal values, especially as event counters or operating hour counters. A tag is a record of an item of data with additional information, for example "tag" refers to meta or additional information appended to the data. In addition to the data that is actually to be stored, information is also stored, for example about its origin or intended use. Calibration values are, for example, the deviations determined during calibrations. Calibration values are values for re-adapting the measuring system to the desired value. Calibration values are generated, for example, in production (for adjusting basic operating points) or during control operation, e.g. by an adjustment/a calibration, and are written into the data memory.

In one embodiment, the field device comprises a microcontroller.

In one embodiment, the coupling body comprises first locking means for locking, especially a bayonet lock, a magnetic lock or a union nut.

In one embodiment, the coupling body is configured to be hermetically sealed.

In one embodiment, the first coupling body is of cylindrical design, especially with an annular diameter of 8-50 mm, especially 12 mm.

In one embodiment, the second interface is configured as an inductive interface.

In one embodiment, the first, inductive interface and/or the second interface, which is configured as an inductive interface, comprises one or more coils that are configured as planar coils or ring coils.

In one embodiment, the first, inductive interface is arranged on the front side, and wherein the second interface is arranged at least in sections on the lateral surface, especially axially along the lateral surface. In one alternative embodiment, the second interface is arranged on the front side, wherein the first, inductive interface is arranged at least in sections on the lateral surface, especially axially along the lateral surface.

In one embodiment, the first, inductive interface is arranged at least in sections on the lateral surface, especially axially along the lateral surface, wherein the second interface is arranged at least in sections on the lateral surface, especially axially along the lateral surface. In one alternative embodiment, the second interface is arranged at least in sections on the lateral surface, especially axially along the lateral surface, wherein the first, inductive interface is arranged at least in sections on the lateral surface, especially axially along the lateral surface.

In one embodiment, the first, inductive, and second interfaces are arranged axially one above the other.

In one embodiment, the first, inductive interface is arranged at least in sections on the lateral surface in a first region, especially axially along the lateral surface, wherein the second interface is arranged at least in sections on the lateral surface in a second region, especially axially along the lateral surface, and wherein the first and second regions are arranged displaced along the circumference, especially about 180°.

In one embodiment, the first, inductive and second interfaces are arranged radially one above the other, and at least one isolator is arranged between the first and the second interface.

In one embodiment, the first coupling body comprises a projection for insertion into an opening of a remote station, wherein the insertion is perpendicular to the longitudinal axis of the field device.

The object is further achieved by a remote station comprising: a third inductive interface complementary to the first inductive interface, at least for transmitting and receiving data, especially for receiving a value dependent on a measurement variable, and at least one fourth interface complementary to the second interface, at least for transmitting energy; and a second coupling body, complementary to the first coupling body, comprising the third inductive interface and the fourth interface.

In one embodiment, the third inductive interface is configured to transmit energy.

In one embodiment, the fourth interface is configured to transmit and receive data.

In one embodiment, the remote station is configured as a fitting, especially as an immersion fitting.

In one embodiment, the remote station is configured as a cable.

In one embodiment, the remote station comprises a microcontroller.

In one embodiment, the second coupling body is of hollow-cylindrical design, at least in sections, especially with an inner diameter of 8-50 mm, especially 12 mm.

In one embodiment, the remote station is geometrically configured in such a way that it is compatible both with sensors which have only a first, inductive interface and with sensors which have a first, inductive interface and a second interface.

In one embodiment, the fourth interface is configured as an inductive interface.

In one embodiment, the third inductive interface and/or the fourth interface, which is configured as an inductive interface, comprises one or more coils and the one or more coils are configured as planar coils or ring coils.

In one embodiment, the third, inductive interface is arranged on the front side, and wherein the fourth interface is arranged at least in sections on the lateral surface, especially axially along the lateral surface. In one alternative embodiment, the fourth interface is arranged on the front side, and wherein the third, inductive interface is arranged at least in sections on the lateral surface, especially axially along the lateral surface.

In one embodiment, the third inductive interface is arranged at least in sections on the lateral surface, especially axially along the lateral surface, and wherein the fourth interface is arranged at least in sections on the lateral surface, especially axially along the lateral surface. In one alternative embodiment, the fourth interface is arranged at least in sections on the lateral surface, especially axially along the lateral surface, and wherein the third inductive interface is arranged at least in sections on the lateral surface, especially axially along the lateral surface.

In one embodiment, the third interface, inductive to the fourth interface is arranged axially one above the other.

In one embodiment, the third inductive interface is arranged at least in sections on the lateral surface in a first region, especially axially along the lateral surface, wherein the fourth interface is arranged at least in sections on the lateral surface in a second region, especially axially along the lateral surface, and wherein the first and second regions are arranged in a displaced manner along the circumference, especially about 180°.

In one embodiment, the third, inductive and fourth interfaces are arranged radially one above the other, and at least one insulator is arranged between the third and the fourth interface.

In one embodiment, the remote station comprises second locking means for locking, especially a bayonet lock, a magnetic lock or a union nut.

In one embodiment, the second coupling body comprises an opening for receiving a projection of a field device, wherein the reception is perpendicular to the longitudinal axis of the object.

The object is further achieved by a measuring system comprising: a sensor as described above and a remote station as described above.

The object is further achieved by a method for starting up a sensor as described above, comprising at least the following steps: Connect the sensor to a remote station, and transmit energy from the remote station to the sensor so that operation of the sensor is enabled.

The object is further achieved by a method for starting up a sensor according to one of the preceding claims, comprising the following steps: Connect the sensor to a remote station; transmit sufficient energy from the remote station to the sensor, so that the transmission of sensor information, especially for transmitting sensor type, identification, serial number and/or tag, is enabled; transmit sensor information from the sensor to the remote station; and transmit energy from the remote station to the sensor as a function of the transmitted sensor information.

If in one embodiment both the first, inductive interface and the second interface are basically capable of transmitting and receiving energy and data, then after the step of transmitting sensor information from the sensor to the remote station, the sensor and the remote station negotiate which interface energy and which interface transmits data or whether energy and data are transmitted via both interfaces.

BRIEF DESCRIPTION OF THE DRAWINGS

This is explained in more detail using the following figures and the table.

FIG. 2*e* shows an overview of the compatibilities.

In the figures, the same features are identified with the same reference signs.

DETAILED DESCRIPTION

Figure 10:
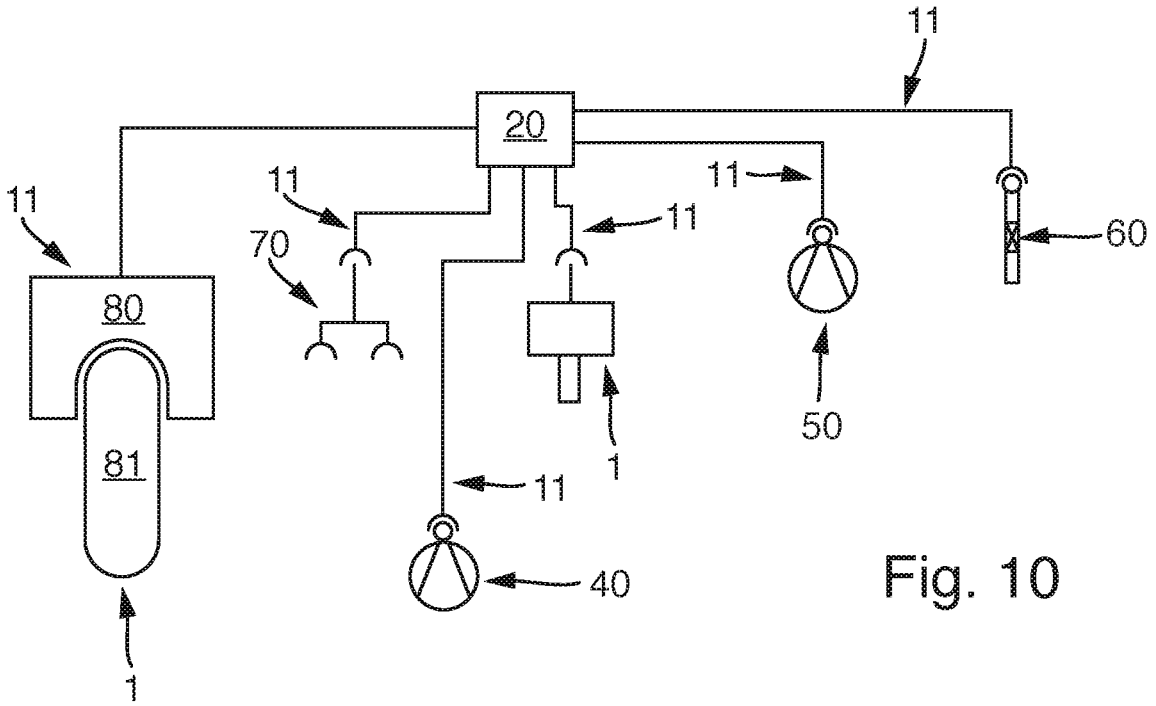
FIG. 10 shows several field devices connected to a higher-level unit.

A claimed measuring system 10 generally comprises a field device and a remote station. First, the configuration of the field device 1 as a sensor is to be discussed. Further embodiments of the field device 1 are schematically indicated in FIG. 10. The field device can thereby be configured as an actuator 40, a pump 50, a fitting 60 or a splitter 70.

Figure 1:
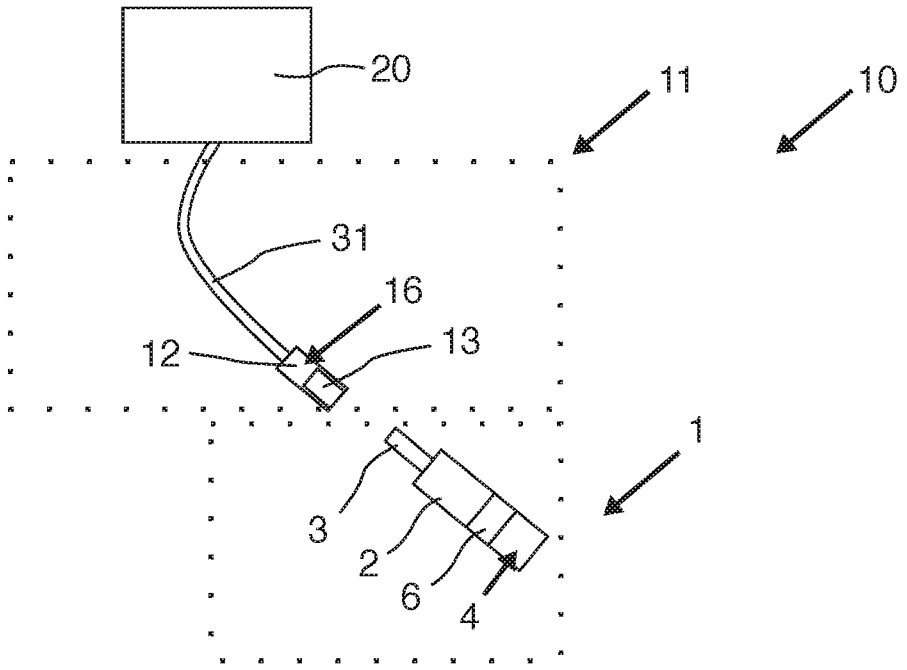
FIG. 1 shows the claimed measuring system in an overview.

A claimed measuring system 10 thus comprises a sensor 1 and a corresponding remote-station 11. The measuring station 10 is shown in detail in FIG. 1. Sensor 1 communicates with a higher-level unit 20 via an interface 3. In the example, a transmitter is connected. The transmitter is in turn connected to a control system (not depicted). In one embodiment, sensor 1 communicates directly with a control system. A cable 31 is connected on the sensor side to transmitter 20, and its other end comprises an interface 13 that is complementary to first interface 3. The remote station 11 comprises the cable 31 along with interface 13. In one embodiment, the remote station 11 is configured as a fitting, for example as an immersion fitting. See FIG. 9 or 10 and the relevant description below. The fitting is identified therein by reference sign 80. The fitting also comprises the third interface 13 and the fourth interface 15 (see below, for instance in FIG. 10).

The interfaces 3, 13 are configured as galvanically separate interfaces, especially as inductive interfaces, which can be coupled to one another by means of a mechanical plug connection. The mechanical plug connection is hermetically sealed, so that no fluid, such as the medium to be measured, air, or dust, can enter from the outside. The interface 13 is referred to as a "third interface" in this application. The type and number of interfaces will be discussed in more detail below with reference to FIGS. 2-6, especially to the "second interface" or the "fourth interface".

Data (bidirectional) is transmitted and received via the interfaces 3, 13. In one embodiment, energy (unidirectional, i.e., from transmitter 20 to sensor 1) is additionally transmitted via interfaces 3, 13. The sensor arrangement 10 is used predominantly in process automation.

Sensor 1 in turn comprises at least one sensor element 4 (only indicated and shown symbolically in FIG. 1) for detecting a measurement variable of process automation. Sensor 1 is then for example a pH sensor, also known as ISFET, generally an ion-selective sensor, a sensor for measuring the redox potential, the absorption of electromagnetic waves in the medium, for example with wavelengths in the UV, IR and/or visible range, oxygen, conductivity, turbidity, the concentration of non-metallic materials or the temperature with the respective measurement variables.

Sensor 1 comprises a first coupling body 2, which comprises the first interface 3. The first coupling body 2 is cylindrical and has a diameter da of 12 mm. The first coupling body 2 also comprises the second interface 5; see below.

As previously mentioned, the first interface 3 is configured to transmit a value dependent on the measured variable to a third interface 13. Sensor 1 comprises a data processing unit 6, e.g. a microcontroller, which processes the values of the measurement variable, e.g. converts them into another data format. In this way, an averaging, pre-processing, and digital conversion can be carried out by the data processing unit. Sensor 1 comprises a data memory, wherein the data memory comprises persistent data, especially calibration data, serial number, tag, calibration values and/or a logbook, of the sensor. "Persistent data" should be understood here to mean data which is "not uncontrollably variable", i.e. that the data remain (stored) even after the program or sensor 1 has been terminated (even in the event of an unforeseen termination, e.g. during power failure) and can be reconstructed and displayed again when the program is called up again.

The remote station 11 can also comprise a data processing unit, for example a microcontroller.

Sensor 1 can be connected via interfaces 3, 13 to remote station 11, and ultimately to a higher-level unit 20. As mentioned, the higher-level unit 20 is a transmitter or a control center, for example. The data processing unit 6 converts the value that is a function of the measurement variable into a protocol that can be understood by the transmitter or the control center. Examples of this include, for example, the proprietary Memosens protocol or else HART, wirelessHART, Modbus, PROFIBUS Foundation Fieldbus, WLAN, ZigBee, Bluetooth, or RFID. This conversion can also be carried out in a separate communications unit instead of in the data processing unit, wherein the communication unit is arranged on the side of the sensor 1 or the remote station 11. The aforementioned protocols also include wireless protocols, so that a corresponding communications unit includes a wireless module. The first and the third interface 3, 13 are thus configured for bi-directional communication between sensor 1 and higher-level unit 20. As mentioned, the first and the third interface 3, 13 also ensure the supply of power to sensor 1 in addition to communication.

The remote station 11 comprises a third interface 13, wherein the third interface 13 is configured to be complementary to the first interface 3. The remote station 11 comprises a data processing unit 16. The data processing unit 16 may serve as a repeater for the transmitted signal. Furthermore, the data processing unit 16 can convert or modify the protocol.

Remote station 11 further includes a second, cylindrical coupling body 12 that is configured to be complementary to first coupling body 2 and can be plugged onto a sleeve-like end section on first coupling body 2, wherein third interface 13 is plugged into first interface 3. An opposite arrangement, in which the third interface 13 has a sleeve-like design and the first interface 3 has a plug-like design, is possible without any inventive effort. The second coupling body 12 has a hollow cylindrical shape at least in sections with an inner diameter di of 12 mm.

The second coupling body 12 also comprises the fourth interface 15; see below.

Figure 2A:
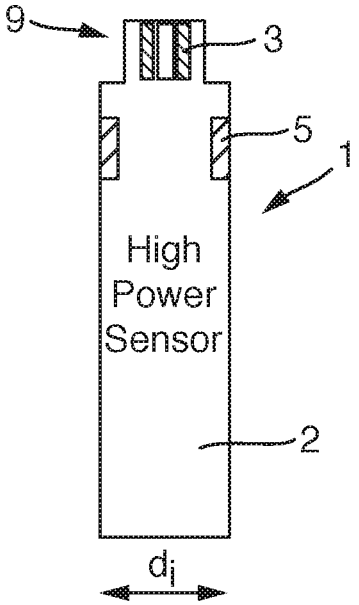
FIGS. 2*a-d* show various embodiments, each in a basic overview of the claimed sensor or the object in cross section.
Figure 2B:
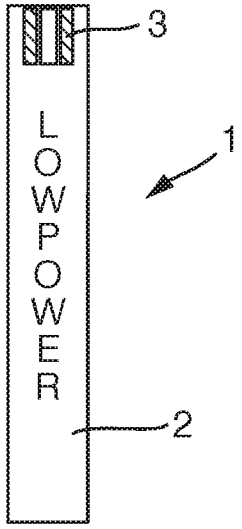
Figure 2C:
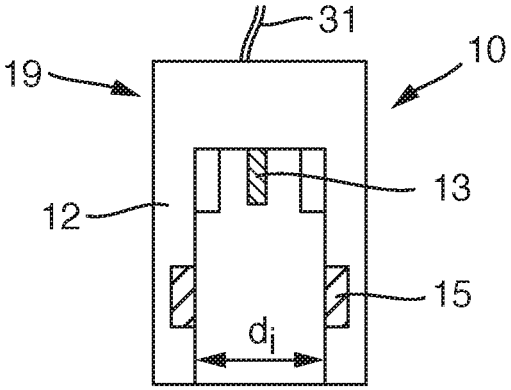
Figure 2D:
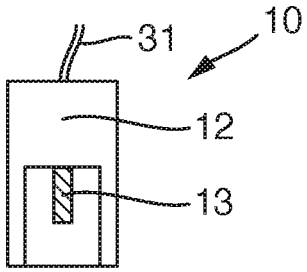

In the sleeve-shaped end section of the second coupling body 12, at least second locking means 19 extend radially inward in order to engage with at least first locking means 9, more precisely at least angled recesses, on the lateral surface of the first coupling body 2 on the sensor 1 and to form a bayonet lock. After inserting the locking means 19 into the recesses 9, the second locking means 19 are rotated in order to lock the sensor 1 relative to the remote-station 11. The second locking means 19 are formed in one piece (one-piece) with the second coupling body 12, for example as an injection-molded part. The first and second locking means 9, 19 are shown in FIGS. 2*a* and 2*c*, respectively.

In general, the first coupling body 2 comprises first locking means 9, while the second coupling body 12 comprises the second locking means 19 for locking into one another. The locking means 9, 19 are complementary to one another. As mentioned, the locking means 9, 19 are configured as a bayonet lock. Alternatively or additionally, these can also be configured as a magnetic lock or in the form of a thread, for example in the form of a union nut.

Sensor 1 comprises a second interface 5. The second interface 5 is configured to receive energy from the remote station 11. In one embodiment, data are also transmitted and received via the second interface 5. Thus, data can be transmitted and received only by means of the first interface 3, by means of the first and second interfaces 3, 5 or in one embodiment only by means of the second interface 5. Furthermore, energy can be received via the first and second interfaces 3, 5 or only via the second interface 5. Transmitting and receiving occur in each case via the corresponding interface at the remote station 11, i.e. the interfaces with the reference numbers 13 or 15.

In one embodiment, energy is transmitted via both interfaces 3, 5, while data is transmitted only via the first interface 3. In this case, sensor 1 is configured as a "high-performance sensor" (reference number 1H) because more energy arrives at it. This is shown in FIG. 2*a*. In contrast, see FIG. 2*b*, a "low-power sensor" (reference number 1L) comprises only one interface 3.

The second interface 5 is an inductive interface. For this purpose, the second interface 5 comprises one or more coils, for example planar coils or ring coils, also called cylinder coils.

In one embodiment, the second or fourth (see below) interface 5, 15 is an optical or capacitive interface. LEDs or laser diodes or photoreceivers or capacitor plates are then used for this purpose.

Remote station 11 comprises a fourth interface 15. Fourth interface 15 is configured to transmit and receive data. Thus, data can be transmitted and received only by means of the third interface 13, by means of the third and fourth interfaces 13, 15 or only by means of the fourth interface 15. In one embodiment, energy can also be transmitted via the fourth interface 15. Thus, energy can be transmitted only via the third interface 13 or via the third and fourth interfaces 13, 15. Transmitting and receiving occur in each case via the corresponding interface on the sensor 1, i.e. the interfaces with the reference numbers 3 or 5.

In one embodiment, energy is transmitted via both interfaces 13, 15, while data is transmitted only via the first interface 13. In this case, remote station 11 is configured as a "high-power remote station" (reference number 10H) because more energy can be transmitted thereto. This is shown in FIG. 2*c*. In contrast, see FIG. 2*d*, a "low-power remote station" (reference number 10L) comprises only one interface 13.

The fourth interface 15 is an inductive interface. For this purpose, the fourth interface 15 comprises one or more coils, for example planar coils or ring coils.

The measuring system 10 is configured in a constructive manner so that both a high-performance sensor 1H and a low-power sensor 1L can be operated. In other words, the remote station 11 is geometrically designed so that it is compatible both with sensors 1 which have only a first, inductive interface 3 and with sensors which have a first, inductive interface 3 and a second interface 5.

FIG. 2*e* shows an overview of the compatibilities. A high-power sensor 1H is not fully operable with a low-power remote station 10L. In some cases, only basic communication may be possible because, for example, there is not enough power available to operate the 1H sensor, e.g. for a specific light source. A high-power sensor 1H can be fully operated with a high-power remote station 10H because it can support both transmission channels via the interfaces 3, 5, 13, 15. A low-power sensor 1L is fully operable with a low-power remote station 10L and a high-power remote station 10H. An adapter ring may be necessary for this mode.

The following steps are necessary for starting up sensor 1: Connect sensor 1 to a remote station 11 and transmit energy from the remote station 11 to the sensor, so that a measurement operation of sensor 11 is enabled. Initially, it is therefore assumed that sensor 1 and the remote station are both of the "high-power" type.

In one embodiment, a negotiation of the type of communication or energy transmission is necessary. Transmitter 20 or one of the microcontrollers 6, 16 can negotiate which sensor 1L, 1H, i.e. which sensor type, and which remote station 1L, 1H and which interfaces 3, 5, 13, 15 are used and whether energy and/or data are transmitted and via which interfaces. In this case, for example, an electrical circuit can detect a low-power sensor 1L with a high-power remote station 10H and deactivate the fourth interface 15 accordingly. For this purpose, sensor information (e.g. sensor type, identification, serial number, etc.) is transmitted from sensor 1 to the remote station 11 and then energy is transmitted from the remote station 11 to sensor 1 depending on the sensor information.

The parameters of the communication can also be changed by the higher-level unit 10 or a data processing unit 6, 16.

In one embodiment, a high-power sensor 1H and a low-power sensor 1L differ in geometric features. For example, a high-power sensor 1H is larger and/or has another locking device.

FIGS. 3-8 show embodiments of the measuring system 10.

The dashed lines in FIG. 3-6 show a magnetically conductive material which can optionally be used for concentrating the magnetic field lines and thus increasing the transmission efficiency and also for decoupling between the interfaces 3.5 and 13, 15 respectively.

Figure 3:
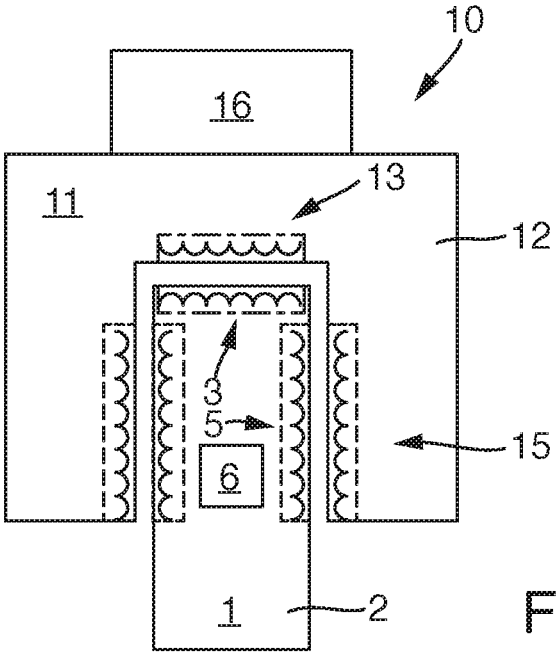
FIG. 3 shows the claimed measuring system in cross section.

In FIG. 3 the first interface 3 (of sensor 1) is arranged on the front side, for example as a planar coil. The second interface 5 (of sensor 1) is arranged at least in sections on the lateral surface, for example, axially along the lateral surface. In FIG. 3 the first interface 3 is thus "up" while the second interface 5 is arranged "laterally". At least the second interface 5 can be configured as a cylindrical coil with a diameter which is slightly smaller than the inner diameter of sensor 1. Accordingly, the third interface 13 (of the remote station 11) is arranged on the front side, for example as a planar coil, in the case of a pot-shaped design of the coupling body 12, for example. The fourth interface 15 (the remote station 11) is arranged laterally and can be configured as a cylindrical coil. The diameter thereof is somewhat different than the opening of the pot-shaped end section of the coupling body 12.

Figure 4:
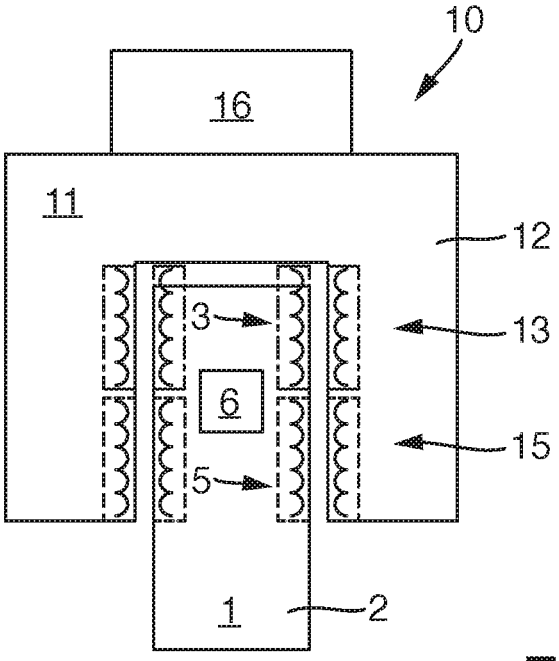
FIG. 4 shows a cross section of the claimed measuring system in one embodiment.

In FIG. 4 the first or third interface 3, 13 is also arranged "laterally". The first, inductive interface 3 is thus arranged at least in sections on the lateral surface, for example, axially along the lateral surface. The interfaces 3, 13 are designed as cylindrical coils. In FIG. 4 the first and second interfaces 3, 5 are thus arranged one above the other.

Figure 6:
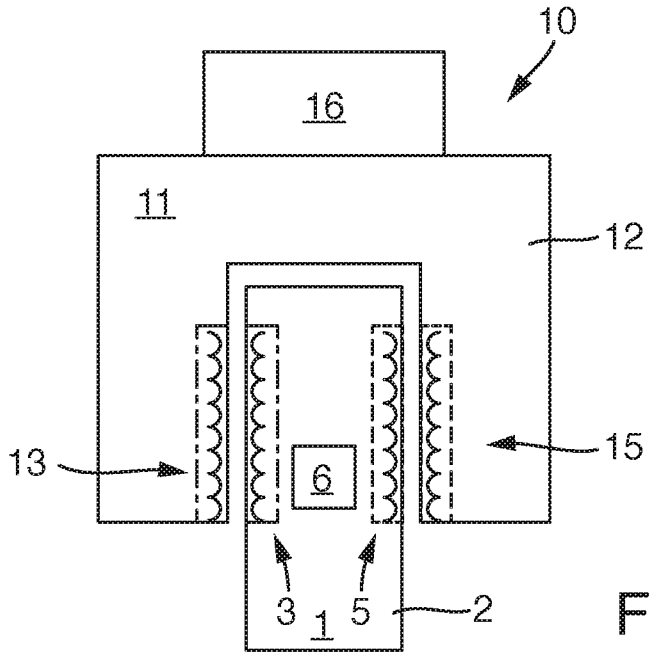
FIG. 6 shows the cross section of a claimed measuring system in an embodiment.

FIG. 6 shows similar arrangement. In this case, the two interface pairs 3, 13 or 5, 15 are not arranged one above the other as in FIG. 4 but are located at the same axial height. One interface pair 3, 13 is offset by an angle with respect to the other pair of interfaces 5, 15. The angle is approximately 180°, 90° or 45°. In general, however, the angle is arbitrary, so the two pairs 5, 15 can also be arranged side by side.

Figure 5A:
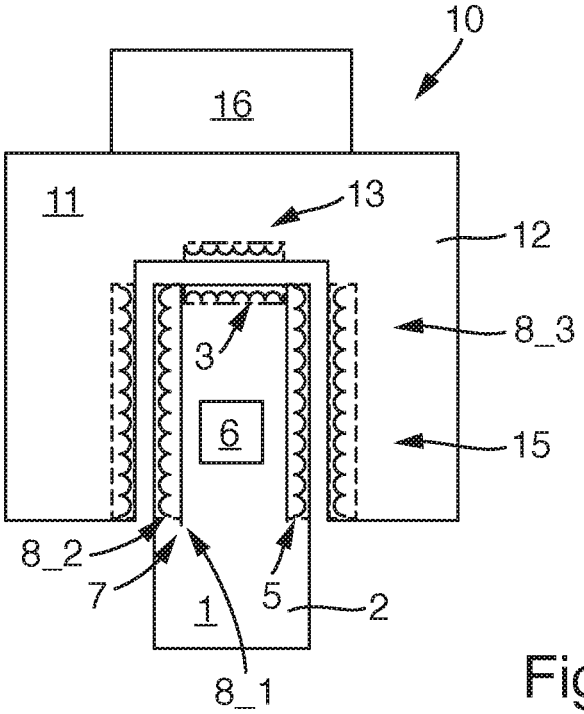
FIG. 5*a-b* show a cross section or plan view of the claimed measuring system in cross section in one embodiment.
Figure 5B:
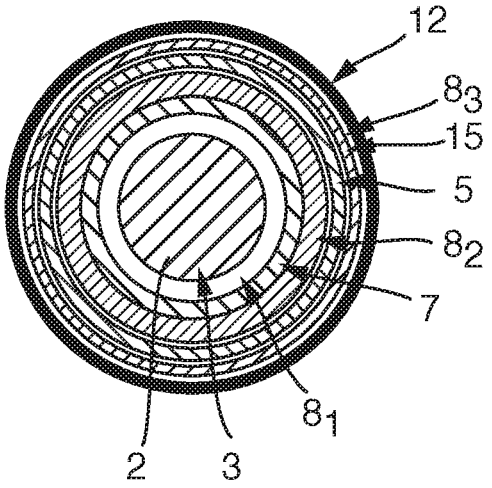

In FIGS. 5*a* and 5*b* the first, inductive interface 3 and the second interface 5 are arranged radially one above the other, and at least one insulator 7 is arranged between the first and the second interface 3, 5. FIG. 5*a* shows the cross section, and FIG. 5*b* shows the corresponding plan view. The interfaces 3, 5 are thus decoupled from each other by suitable shielding material, which prevents overlapping fields. In one embodiment, a ferromagnetic material 81, for example a ferrite, is arranged around the first interface 3 which is configured as a cylindrical coil. This material 81 is followed by the insulator 7, then a second ferromagnetic material 82. This is followed by the second interface 5 which is also configured as a cylindrical coil. Ferromagnetic material 83 can be arranged above the second interface 5.

As explained above, the third interface 13 has a sleeve-like configuration and the first interface 3 has a plug-like configuration or vice versa. This is the case especially if the coupling bodies 2, 12 are of cylindrical design. In the embodiments in FIGS. 3-6, it is thus possible for sensor 1 to be placed essentially vertically into the remote station 11, i.e. from bottom to top in the figures. This is also possible in the embodiments in FIG. 7*a-g*.

However, especially in the embodiments of FIG. 3-6 as well as FIG. 7*a-b*, and FIG. 7*d-f*, it is possible that sensor 1 can also be placed laterally, i.e. into the sheet, into the remote station 11. The remote-station 11 is then configured accordingly.

Figure 8A:
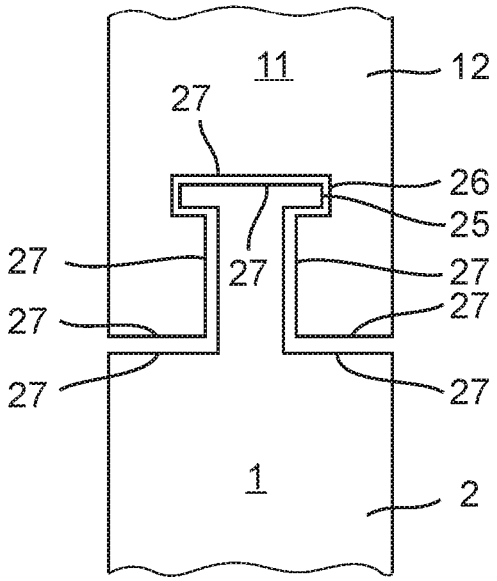
FIG. 8*a-c* show embodiments of the arrangement of the interfaces or the bodies.
Figure 8B:
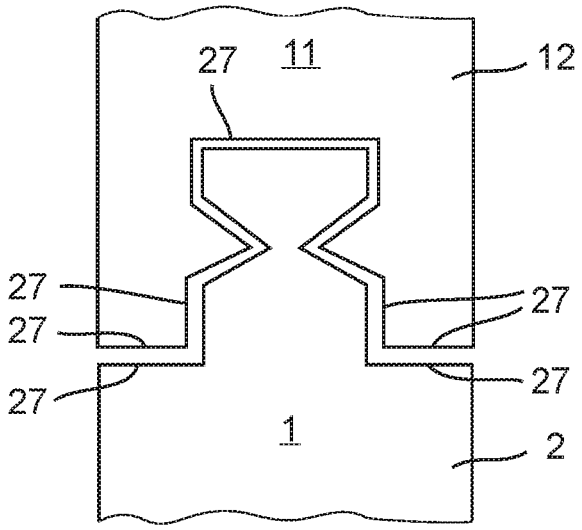
Figure 8C:
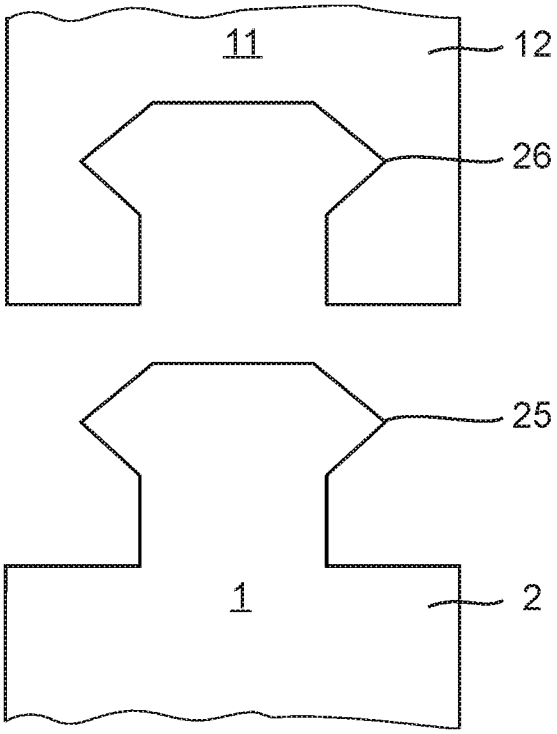

FIG. 8*a-c* show further examples in assembled or disassembled position, where only a lateral insertion of sensor 1 is possible. For this purpose, the coupling body 2 of sensor 1 comprises a projection 25 and the coupling body 12 of the remote station 11 comprises a correspondingly shaped groove 26. Various variants are possible, such as triangular, cuboid, etc. In general the object 11 comprises an opening, and the sensor comprises a corresponding projection or latching lug.

An opposite arrangement is also possible, i.e. with a corresponding groove on sensor 1.

The interfaces 3, 5, 13, 15 are not shown in FIGS. 8*a-c*. Possible positions for planar or cylindrical coils are identified in FIGS. 8*a-b* by the reference number 27; this applies accordingly for FIG. 8*c*.

Figure 7A:
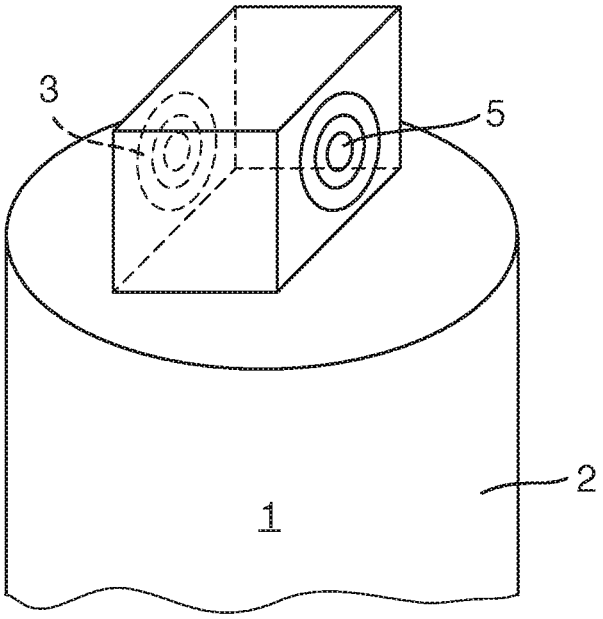
FIG. 7*a-g* show embodiments of the arrangement of the interfaces on the sensor.
Figure 7B:
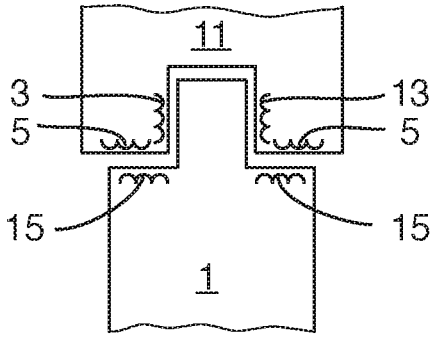
Figure 7C:
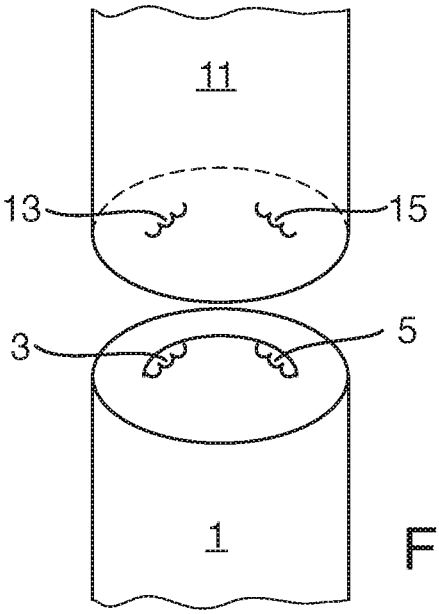
Figure 7D:
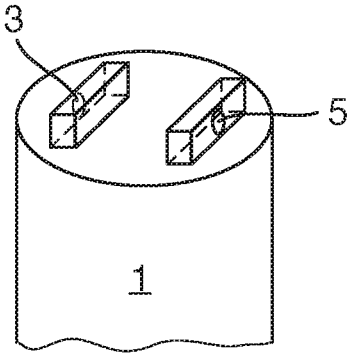
Figure 7E:
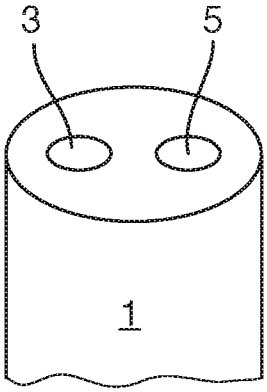
Figure 7F:
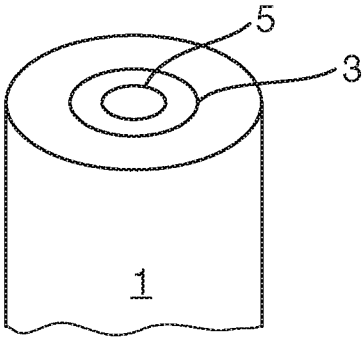
Figure 7G:
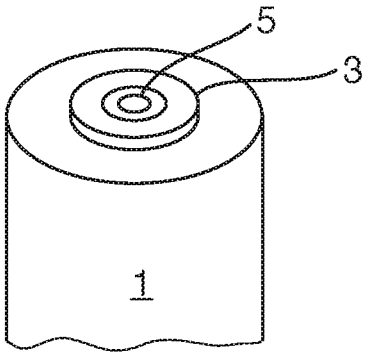

FIGS. 7*a-g* show various embodiments of the arrangement of the interfaces 3, 5, 13, 15 on sensor 1. FIG. 7*a* shows a cuboid attachment on the sensor body 2 or in which the interfaces are arranged. FIG. 7*b* shows a structure in which the interfaces can basically be attached at three different positions; two of them are drawn in; the third possible position is located at the front near the reference number "11". This embodiment is similar to that in FIG. 2*a*. FIG. 7*c* shows an embodiment with a hemispherical configuration at the end region of the body 2 or a corresponding depression in the body 12. FIG. 7*d* shows two cuboid structures on the body. FIG. 7*e* shows two offset coils on or at the surface of the body. FIG. 7*f* shows two concentrically arranged coils. FIG. 7*g* shows a similar embodiment to FIG. 7*f*, but the coils are offset from the surface. If necessary, the coils are insulated from one another by an appropriate insulator.

As mentioned, planar coils or cylindrical coils can be used in principle. Depending on the embodiment, one or the other is advantageous. The following table shows possible arrangements of the embodiments shown, where "P" stands for planar coil and "C" stands for cylinder coil. Although the coils shown are preferred, the respective other embodiment is also conceivable.

| | Interface 3, 13 | Interface 5, 15 |
|---|---|---|
| FIG. 3 | P or C | C |
| FIG. 4 | C | C |
| FIG. 5a/b | P or C | C |
| FIG. 6 | P | P |

-continued

| | Interface 3, 13 | Interface 5, 15 |
|---|---|---|
| FIG. 7a | P | P |
| FIG. 7b | P or C | P or C |
| FIG. 7c | P | P |
| FIG. 7d | P | P |
| FIG. 7e-g | P or C | P or C |
| FIG. 8a-c | P or C | P or C |

In one embodiment, sensor 1 or the remote station 11 comprises more than two interfaces. Several interfaces can be used simultaneously for energy transmission or communication. In one embodiment, different data are transmitted via different interface pairs.

Figure 9:
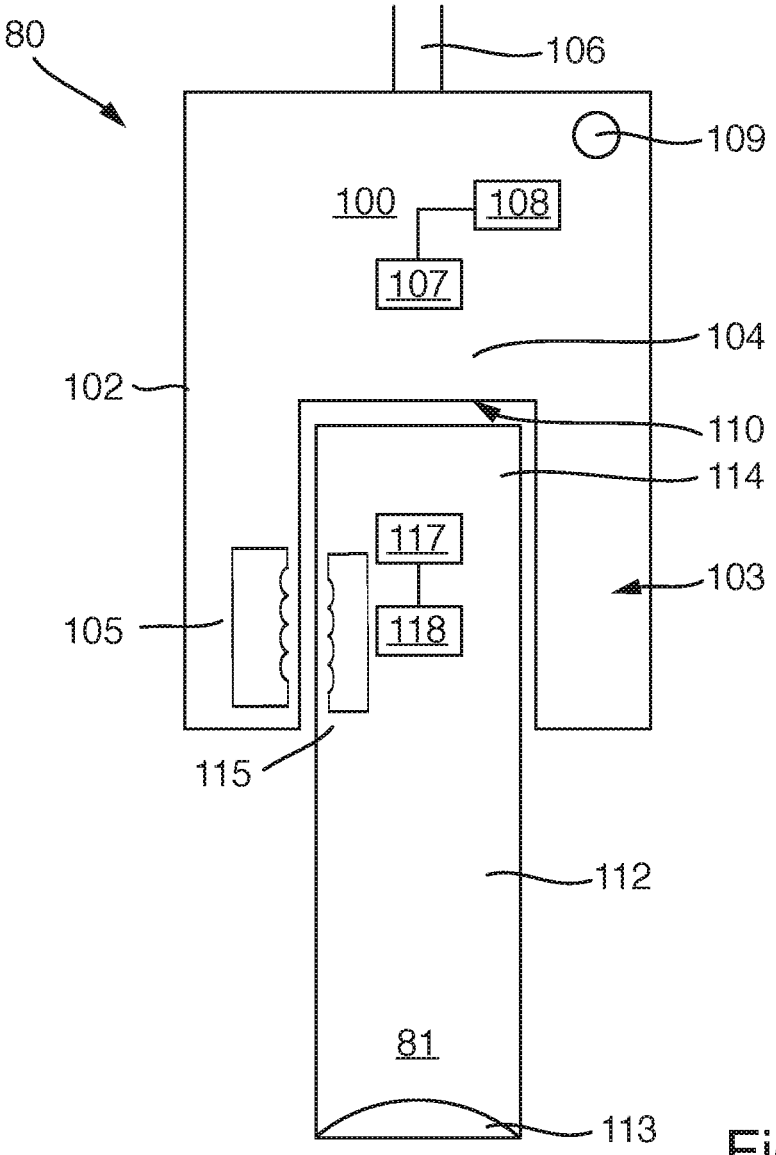
FIG. 9 shows a remote station which is configured as a fitting.

FIG. 9 shows a remote station 11 which is configured as a fitting 80. A corresponding fitting 80 is connected to the sensor 81, 1.

Sensor 81, 1 is configured for immersion in a medium to be measured. The fitting arrangement is attached to a container, basin, pipe, etc. by means of an appropriate fastening device. For this purpose, the fastening device comprises, for example, screws, nuts, corresponding linkages and mountings.

Fitting 80 comprises a housing 102. Surfaces and edges of the housing 102 which can be brought into contact with a medium, especially all surfaces and edges, have a smooth and rounded design. Embodiments having one or more edges are also possible. In one embodiment, the housing 102 is designed in one piece. Of course, embodiments are also possible in which the housing 102 consists of two or more parts.

The housing 102 has an end section 103 configured to accommodate sensor 81, 1. The end section 103 is for example pot-shaped. The pot-shaped section 103 has an opening which is, for example, circular. The end section 103 thus corresponds to a straight cylinder open on one side with a base. The housing 112 of sensor 81, 1 has an outer contour corresponding to the inner part of the end section 103. The inner diameter of the pot-shaped end section 103 is at least 12 mm, especially at least 25 mm, especially at least 40 mm. Sensor 81, 1 is inserted into the opening. The end section 103 comprises a base 110 which serves as a stop for sensor 81, 1. In the example in FIG. 7 the base 10 is straight, the end section 103 as mentioned is a straight cylinder, and the sensor 81, 1 to be introduced is also straight and substantially cylindrical. The examples in FIG. 9 show the base 110 as a curved surface, for example, hemispherical. The end section 103 and the sensor 81, 1 are designed accordingly.

The fitting 80 comprises connecting means 106 at the end opposite the end section 103. Communication to a higher-level unit 20, e.g. a control system or a transmitter, is via the connection means 106. The connection means 106 are configured, for example, as cables. The cable is for example a fixed component of the fitting 80. This is preinstalled by the manufacturer in the fitting 80. The connection means 106 are arranged in the housing 102 at least in sections. The power supply is effected via the connection means 106.

The fitting 80 comprises a display 109, for example one or more LEDs, a display or the like. An acoustic display is also an option. The display device 109 can be used to display the status of fitting 80 (e.g. via a warning tone), a connected sensor 81, 1, a connection between sensor 1 and fitting 80, and a measured value of a connected sensor 81, 1. The display device 109 is arranged, for example, in the vicinity of the connection means 106.

The sensor 81, 1 also comprises a display device. The display unit can be used to display the status of the connected fitting 80, the sensor 81, 1, a connection between sensor 81, 1 and fitting 80 and a measured value etc. The display device comprises, for example, one or more LEDs, a display, etc. The display device can be arranged, for example, on the side of the sensor 81, 1 on which the sensor 81, 1 is mounted in the fitting 80.

The sensor 81, 1 comprises a sensor element 113 for the acquisition of a process variable to be determined, such as pH value, conductivity, oxygen, nitrate, nitride, turbidity, etc. In general, the process variable is a process variable of process automation. This stated here regarding FIG. 7 regarding sensor 80 applies equally to all sensors 1 of this application.

Sensor 81, 1 comprises a data processing unit 117 which calculates a measured value dependent on the process variable, for example. For this purpose, the data processing unit 117 also comprises one or more memories in which, for example, calibration values are stored. Sensor 81, 1 communicates with the fitting 80 (see below) via the data processing unit 117 or the data processing unit 107 of the fitting 80. Raw data of the measurement can also be sent to the sensor mounting 1. These raw data are then converted into the actual measured value in the fitting 80.

The fitting 80 or its housing 102 comprises first retaining means which are configured to hold the sensor 81, 1 in the pot-shaped end section 103 of the fitting 80. Accordingly, the sensor 81, 1 or its housing 112 comprises second retaining means, which are configured corresponding to the first retaining means. The retaining means are configured as a permanent magnet. The retaining means comprise a soft magnetic material. This prevents the accumulation of metal parts on the fitting. Sensor 81, 1 can be cleaned more easily than the fitting 80. The reverse arrangement is possible in principle. In one embodiment, sensor 81 is held in the fitting 80 only by means of a frictional connection. For this purpose, sensor 81, 1 or the fitting 80 can have a certain material combination so that the sensor 81 cannot simply slide out of the sensor mounting.

This results in an intrinsically dense sensor arrangement. Even without sensor 81 installed, the fitting 80 is sealed to the medium and liquid cannot penetrate into the sensor mounting 1.

Additionally or alternatively, the retaining means may comprise a cutoff device which is arranged in the region of the open end of the pot-shaped end section 103. The retaining means comprise, for example, a hinge, coupling, especially clamping coupling, lever or bayonet. A clamping clutch includes a slotted ring on which a conical element presses.

Surfaces and edges of sensor 81 which can be brought into contact with the medium, especially all surfaces and edges of sensor 81, have a smooth and rounded design.

The housing 102 of the fitting comprises first communication means 104 via which the fitting 80 can communicate with the sensor 81. For this purpose, sensor 81 comprises appropriate second communication means 114 corresponding thereto. The first and second communication means 104, 114 are configured, for example, as inductive, capacitive or optical interfaces. FIG. 8 shows the embodiment with inductive interfaces, i.e. with coils. The first and second communication media 104, 114 are used for wireless transmission of energy from fitting 1 to sensor 81, and for wireless transmission and reception of data between fitting 80 and sensor 81.

FIG. 8 shows an embodiment in which the communication means 104, 114 are each configured as cylinder coils. Other coil shapes such as a toroidal coil are possible. In FIG. 7, the second communication means 114 form the "inner" coil pair, while the first communication means 104 forms the "outer" coil pair. The outer coil pair encompasses the inner coil pair. In one embodiment, the communication means 104, 114 are arranged on the front side of the sensor 81 or the fitting 80 respectively. The communication means 104, 114 thus form the interfaces 3, 13. Another arrangement is possible in principle and is described in FIGS. 3-6. The communication means 105, 115 form the interfaces 5, 15 respectively. This arrangement can also be in accordance with FIGS. 3-7 and as described above.

A data processing unit 107, such as a microcontroller with a memory, is arranged in the housing 102. The data processing unit 107 processes data, e.g. the measured values of a connected sensor 81. These are processed, calculated, converted if necessary and sent to the higher-level unit. The data exchange with sensor 1 is organized via the data processing unit 107. Depending on the embodiment, i.e. depending on the microcontroller, CPU, memory, etc., the data processing unit 107 performs tasks of a transmitter. In one embodiment, the data processing unit 107 comprises a wireless module 108, such as a Bluetooth, NFC, Wifi (according to the IEEE 802.11 standards) or infrared module.

In one embodiment, the data processing unit 117 of the sensor 81 also includes a wireless module 118, such as a Bluetooth, NFC, Wifi (according to the IEEE 802.11 standards) or infrared module. The respective wireless modules 108, 118 may also be arranged separately from the data processing units 107, 117 and as a separate module. The communication means 104 are connected to the connection means 106, optionally via the data processing unit 107. The communication means 114 of the sensor 81, 1 are connected to the connection means 116, optionally via the data processing unit 117. In one embodiment, sensor 81, 1 and the fitting 80 communicate via the respective wireless modules 108, 118. In this case, these wireless modules 108, 118 may be considered communication means 104, 114.

The invention claimed is:

1. A field device, comprising:

a first inductive interface for transmitting and receiving data, including for transmitting a value which is dependent on a measurement variable, and for receiving energy;

a second inductive interface separated from the first inductive interface, wherein the second inductive interface is embodied for receiving energy and for transmitting and receiving the data;

a first coupling body that includes the first inductive interface and the second inductive interface;

a microcontroller; and a data memory, wherein the data memory includes persistent data that includes calibration data, serial number, a tag, calibration values, and a logbook of the field device, wherein the microcontroller is configured to:

determine if the field device is connected with a remote station;

determine if the remote station provides energy to the field device via only the first inductive interface;

determine if the remote station provides energy to the field device via the first inductive interface and the second inductive interface;

configure the field device as a field device that is fully operated via only the first inductive interface when the remote station provides energy to the field device via only the first inductive interface, and configure the field device as a field device that is fully operated via the first inductive interface and the second inductive interface when the remote station provides energy to the field device via the first inductive interface and the second inductive interface.

2. The field device according to claim 1, wherein the field device is configured as a sensor, the field device further comprising:

a sensor element for detecting the measurement variable.

3. The field device according to claim 1, wherein the first coupling body includes a first locking means for locking, wherein the first locking means includes a bayonet lock, a magnetic lock, or a union nut.

4. The field device according to claim 1, wherein the first coupling body is hermetically sealed.

5. The field device according to claim 1, wherein the first coupling body is of cylindrical design having an outside diameter of 8-50 mm.

6. The field device according to claim 1, wherein the first inductive interface and the second inductive interface include one or more coils and the one or more coils are configured as planar coils or ring coils.

7. The field device according to claim 1, wherein the first inductive interface is arranged on a front side of the first coupling body, and wherein the second inductive interface is arranged at least in sections on a lateral surface of the first coupling body.

8. The field device according to claim 1, wherein the first inductive interface is arranged at least in sections on a lateral surface of the first coupling body, and wherein the second inductive interface is arranged at least in sections on the lateral surface of the first coupling body.

9. The field device according to claim 8, wherein the first inductive interface is arranged axially above the second inductive interface.

10. The field device according to claim 8, wherein the first inductive interface is arranged at least in sections on the lateral surface of the first coupling body in a first region, wherein second inductive interface is arranged at least in sections on the lateral surface of the first coupling body in a second region, and wherein the first and second regions are arranged in a displaced manner along a circumference.

11. The field device according to claim 8, wherein the first inductive interface and the second inductive interface are arranged radially one above the other, and at least one insulator is arranged between the first inductive interface and the second interface.

12. The field device according to claim 1, wherein the first coupling body includes a projection for insertion into an opening of the remote station, and wherein the insertion is perpendicular to a longitudinal axis of the field device.

13. A remote station, comprising:

a third inductive interface complementary to a first inductive interface of a field device, wherein the third inductive interface is configured to transmit and receive data, including to receive a value which is dependent on a measurement variable, and to transmit energy;

a fourth inductive interface separated from the third inductive interface and complementary to a second inductive interface of the field device, wherein the fourth inductive interface is configured to transmit energy and to transmit and receive the data;

a second coupling body complementary to a first coupling body of the field device, wherein the second coupling body includes the third inductive interface and the fourth inductive interface; and a microcontroller, wherein the microcontroller is configured to:

enable the third inductive interface and the fourth inductive interface to transmit energy;

determine if the field device is connected to the remote station;

determine if the remote station provides energy to the field device via both the third inductive interface and the fourth inductive interface;

determine if the remote station provides energy to the field device via only the third inductive interface; and disable the fourth inductive interface when the remote station provides energy to the field device via only the third inductive interface.

14. The remote station according to claim 13, wherein the remote station is configured as a fitting.

15. The remote station according to claim 13, wherein the remote station is configured as a cable.

16. The remote station according to claim 13, wherein the second coupling body is of hollow-cylindrical design at least in sections, having an inner diameter of 8-50 mm.

17. The remote station according to claim 13, wherein the remote station is configured such that it is compatible both with a first field device having only a first inductive interface of the first field device and with a second field device having a first inductive interface and a second inductive interface of the second field device.

18. The remote station according to claim 13, wherein the third inductive interface and the fourth inductive interface include one or more coils and the one or more coils are configured as planar coils or ring coils.

19. The remote station according to claim 13, further comprising:

a locking means for locking, wherein the locking means includes a bayonet lock, a magnetic lock, or a union nut.

20. The remote station according to claim 13, wherein the second coupling body includes an opening for receiving a projection of the field device, and wherein the reception is carried out perpendicular to a longitudinal axis of the remote station.

21. A measuring system, comprising: a field device, including:

a first inductive interface for transmitting and receiving data, including for transmitting a value which is dependent on a measurement variable, and for receiving energy;

a second inductive interface separated from the first inductive interface, wherein the second inductive interface is embodied for receiving energy and for transmitting and receiving the data;

a first coupling body that includes the first inductive interface and the second inductive interface;

a microcontroller of the field device; and a data memory, wherein the data memory includes persistent data that includes calibration data, serial number, a tag, calibration values, and a logbook of the field device, wherein the microcontroller of the field device is configured to:

determine if the field device is connected with a remote station;

determine if the remote station provides energy to the field device via only the first inductive interface;

determine if the remote station provides energy to the field device via the first inductive interface and the second inductive interface;

configure the field device as a field device that is fully operated via only the first inductive interface when the remote station provides energy to the field device via only the first inductive interface, and configure the field device as a field device that is fully operated via the first inductive interface and the second inductive interface when the remote station provides energy to the field device via the first inductive interface and the second inductive interface, and the remote station, including:

a third inductive interface complementary to the first inductive interface of the field device, wherein the third inductive interface is configured to transmit and receive the data, including to receive the value which is dependent on the measurement variable, and to transmit energy;

a fourth inductive interface separated from the third inductive interface and complementary to the second inductive interface of the field device, wherein the fourth inductive interface is configured to transmit energy and to transmit and receive the data;

a second coupling body complementary to the first coupling body of the field device, wherein the second coupling body includes the third inductive interface and the fourth inductive interface; and a microcontroller of the remote station, wherein the microcontroller of the remote station is configured to:

enable the third inductive interface and the fourth inductive interface to transmit energy;

determine if the field device is connected to the remote station;

determine if the remote station provides energy to the field device via both the third inductive interface and the fourth inductive interface;

determine if the remote station provides energy to the field device via only the third inductive interface; and disable the fourth inductive interface when the remote station provides energy to the field device via only the third inductive interface.

22. A method for starting up a field device, comprising:

providing the field device, including:

a first inductive interface for transmitting and receiving data, including for transmitting a value which is dependent on a measurement variable, and for receiving energy;

a second inductive interface separated from the first inductive interface, wherein the second inductive interface is embodied for receiving energy and for transmitting and receiving the data;

a first coupling body that includes the first inductive interface and the second inductive interface;

a microcontroller of the field device; and a data memory, wherein the data memory includes persistent data that includes calibration data, serial number, a tag, calibration values, and a logbook of the field device, wherein the microcontroller of the field device is configured to:

determine if the field device is connected with a remote station;

determine if the remote station provides energy to the field device via only the first inductive interface;

determine if the remote station provides energy to the field device via the first inductive interface and the second inductive interface;

configure the field device as a field device that is fully operated via only the first inductive interface when the remote station provides energy to the field device via only the first inductive interface, and configure the field device as a field device that is fully operated via the first inductive interface and the second inductive interface when the remote station provides energy to the field device via the first inductive interface and the second inductive interface;

providing the remote station, including:

a third inductive interface complementary to the first inductive interface of the field device, wherein the third inductive interface is configured to transmit and receive the data, including to receive the value which is dependent on the measurement variable, and to transmit energy;

a fourth inductive interface complementary to the second inductive interface of the field device, wherein the fourth inductive interface is configured to transmit energy and to transmit and receive the data;

a second coupling body complementary to the first coupling body of the field device, wherein the second coupling body includes the third inductive interface and the fourth inductive interface;

a microcontroller of the remote station, wherein the microcontroller of the remote station is configured to:

enable the third inductive interface and the fourth inductive interface to transmit energy;

determine if the field device is connected to the remote station;

determine if the remote station provides energy to the field device via both the third inductive interface and the fourth inductive interface;

determine if the remote station provides energy to the field device via only the third inductive interface; and disable the fourth inductive interface when the remote station provides energy to the field device via only the third inductive interface; connecting the field device to the remote station; and transmitting energy from the remote station to the field device so that operation of the field device is enabled.

23. A method for starting up a field device, comprising:

providing the field device, including:

a first inductive interface for transmitting and receiving data, including for transmitting a value which is dependent on a measurement variable, and for receiving energy;

a second inductive interface separated from the first inductive interface, wherein the second inductive interface is embodied for receiving energy and for transmitting and receiving the data;

a first coupling body that includes the first inductive interface and the second inductive interface;

a microcontroller of the field device; and a data memory, wherein the data memory includes persistent data that includes calibration data, serial number, a tag, calibration values, and a logbook of the field device, wherein the microcontroller of the field device is configured to:

determine if the field device is connected with a remote station;

determine if the remote station provides energy to the field device via only the first inductive interface;

determine if the remote station provides energy to the field device via the first inductive interface and the second inductive interface;

configure the field device as a field device that is fully operated via only the first inductive interface when the remote station provides energy to the field device via only the first inductive interface, and configure the field device as a field device that is fully operated via the first inductive interface and the second inductive interface when the remote station provides energy to the field device via the first inductive interface and the second inductive interface;

providing the remote station, including:

a third inductive interface complementary to the first inductive interface of the field device, wherein the third inductive interface is configured to transmit and receive the data, including to receive the value which is dependent on the measurement variable, and to transmit energy;

a fourth inductive interface separate from the third inductive interface and complementary to the second inductive interface of the field device, wherein the fourth inductive interface is configured to transmit energy and to transmit and receive the data;

a second coupling body complementary to the first coupling body of the field device, wherein the second coupling body includes the third inductive interface and the fourth inductive interface; and a microcontroller of the remote station, wherein the microcontroller of the remote station is configured to:

enable the third inductive interface and the fourth inductive interface to transmit energy;

determine if the field device is connected to the remote station; determine if the remote station provides energy to the field device via both the third inductive interface and the fourth inductive interface; determine if the remote station provides energy to the field device via only the third inductive interface; and disable the fourth inductive interface when the remote station provides energy to the field device via only the third inductive interface; connecting the field device to the remote station; transmitting sufficient energy from the remote station to the field device to carry out a transmission of field device information, including a transmission of field device type, identification, serial number, and/or tag;

sending the field device information from the field device to the remote station; and transmitting energy from the remote station to the field device as a function of the transmitted field device information.

* * * * *